United States Patent [19]

McGeary et al.

[11] 4,420,020

[45] Dec. 13, 1983

[54] WIRE COMBING DEVICE

[75] Inventors: James E. McGeary; Walter C. Shatto, Jr., both of Harrisburg, Pa.

[73] Assignee: AMP Incorporated, Harrisburg, Pa.

[21] Appl. No.: 376,071

[22] Filed: May 7, 1982

Related U.S. Application Data

[63] Continuation of Ser. No. 157,780, Jun. 9, 1980, abandoned.

[51] Int. Cl.[3] ..... B21F 1/02

[52] U.S. Cl. ..... 140/147; 29/749; 29/753

[58] Field of Search ..... 140/147, 149; 29/749, 29/751, 753

[56] References Cited

U.S. PATENT DOCUMENTS

| | | | |
|---|---|---|---|
| 2,337,055 | 12/1943 | Mathias et al. | 140/147 X |
| 3,936,933 | 2/1976 | Folk et al. | 29/749 X |
| 3,950,062 | 4/1976 | Reavis, Jr. | 339/97 R |
| 4,019,800 | 4/1977 | Soes | 339/97 R |
| 4,132,252 | 1/1979 | Shatto, Jr. | 140/147 |
| 4,220,390 | 9/1980 | Cobaugh et al. | 339/97 R |

*Primary Examiner*—Fred Silverberg

*Attorney, Agent, or Firm*—Richard B. O'Planick; Adrian J. LaRue

[57] ABSTRACT

A combing device for 90 degree axial rotation of a pair of adjacent cable conductors from an original axial orientation. The device comprises a profiled conductor manipulating channel adapted having an upper outwardly flared surface extending the longitudinal length of one sidewall defining the channel. A tapered cut is formed into the flared surface from one end of the channel, and is of decreasing depth therealong, terminating at a point on the flared sidewall surface. Upon simultaneously addressing two parallel and adjacent conductors into the channel at a suitable angle thereto, and drawing the conductors toward the opposite end of the channel while decreasing the angle therebetween, one conductor freely enters the channel, and the other conductor, after having been momentarily deterred by engagement against the tapered cut, rolls into the channel atop the first conductor.

12 Claims, 8 Drawing Figures

Fig. 5
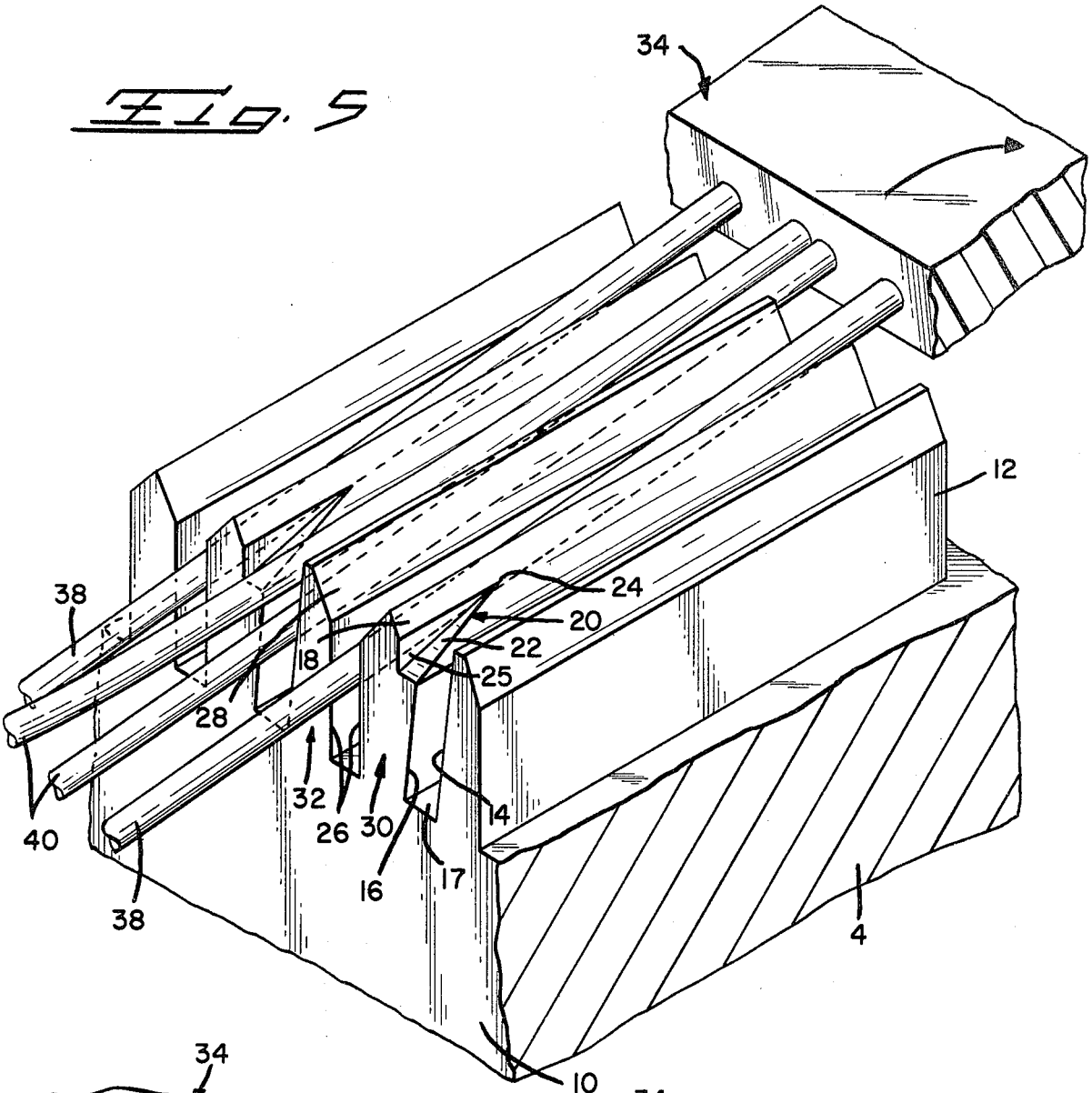
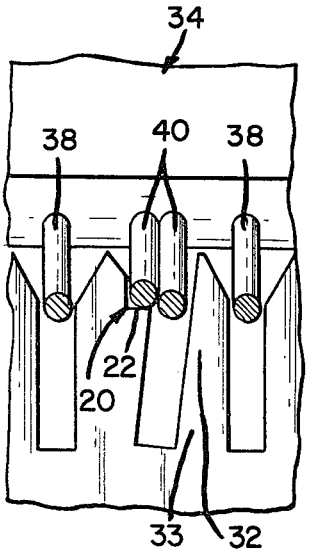
Fig. 6
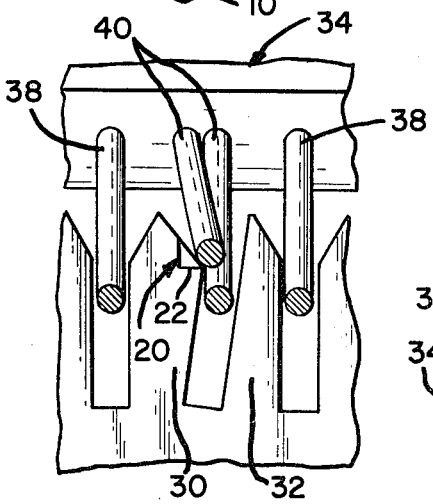
Fig. 7
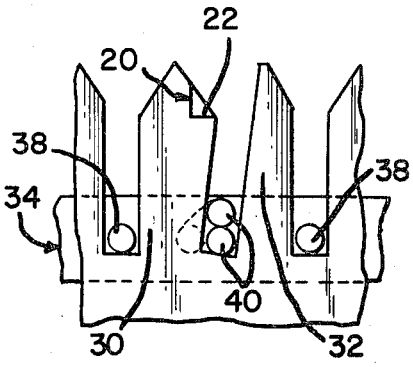
Fig. 8

WIRE COMBING DEVICEThis is a continuation, of application Ser. No. 157,780, filed June 9, 1980, now abandoned.

BACKGROUND OF THE INVENTION

1. The Field Of The Invention

The present invention relates generally to combing devices for positioning the plurality of conductors in a multiconductor cable. More specifically, the invention relates to a combing device of the type intended for use in orienting specified pairs of adjacent conductors of the cable 90 degrees from an original axial orientation.

2. The Prior Art

In the application tooling for connectorizing the ends of a plurality of conductors in a transmission cable or the like, wire handling combs are often deployed in separting and accurately positioning individual conductors for subsequent address to a connector. Some connectors are programmable, and contemplate the common termination of two conductors in a single terminal slot. For such terminations, it is desirable that selective pairs of adjacent conductors, which are intended to be jointly terminated, be pre-oriented from their normal horizontal axial orientation into an axially vertical relationship.

Relying upon a profiled comb slot to achieve axial rotation of adjacent conductors is one viable approach to the problem. Because the size of individual conductors in a transmission cable tend to be generally very fine gauge, it is imperative that a suitably profiled comb slot achieve the desired axial rotation of conductors dependably and without any risk of mechanical interference between the comb slot and the movement of conductors therethrough which could cause conductor breakage.

Previous combs tried by the industry utilize profiled comb slots which function in a two dimensional manner, that is, two adjacent conductors are intended to be moved axially downward into a profiled slot and against beveled surfaces which impart horizontal forces on the conductors to effectuate their rotation. The conductors, accordingly, are to be stictly moved laterally of their axis and downward into a slot. While this insertion approach works generally well in most cases, the possibility still exists in currently configured comb slots for the conductors to bind within the cable entry area during their insertion, with breakage normally resulting therefrom.

The industry, therefore, has been in need of a combing device, or template, which would positively and dependably achieve 90 degree axial rotation of adjacent conductors into a vertical orientation, while minimizing the risk of binding and breakage. Moreover, since only selected adjacent conductors are to be so re-oriented, it would be desirable for a combing template to also facilitate presentation of single conductors and rotated pairs of conductors on equal center line spacings for a more orderly subsequent presentation to the connector.

SUMMARY OF THE PRESENT INVENTION

The present invention teaches a combing template structure for achieving 90 degree axial rotation of a pair of adjacent cable conductors from an original axial relationship. The invention contemplates a threee dimensional lacing of a plurality of cable conductors into appropriate template channels, with specified conductors entering single conductor receiving channels, and specified pairs of adjacent conductors entering dual conductor receiving channels. Each dual conductor receiving channel is profiled having an upper outwardly flared surface extending the longitudinal length of one sidewall defining the channel. A tapered cut is formed into the flared surface from one end, and is of decreasing depth therealong, terminating at a point on the flared sidewall surface. Upon simultaneously addressing a pair of parallel conductors into the channel at a suitable initial angle therewith, and drawing the conductors toward the opposite end of the channel while decreasing the angle therebetween, one conductor freely drops into the channel, and the other conductor, having been momentarily detained by engagement against the tapered cut, is rolled into the channel atop the first conductor.

Accordingly, it is an object of the present invention to provide a combing template having a profiled channel for dependable 90 degree rotation of a pair of adjacent cable conductors from an original orientation.

It is a further object of the present invention to provide a combing template for transposing a plurality of cable conductors into equal center line spacings, with selected pairs of adjacent conductors rotated 90 degree, into a modified axial orientation and sharing a single center line spacing.

Still further, it is an object of the present invention to provide a combing template having a channel therein profiled for achieving a binding free re-orientation of a pair of adjacent cable conductors from an axially horizontal to a vertical relationship.

A still further object of the present invention is to provide a combing template which is economically and readily produced.

These and other objects, which will be apparent to one skilled in the art, are achieved by a preferred embodiment which is described in detail below, and which is illustrated in the accompanying drawings.

BRIEF DESCRIPTION OF THE ACCOMPANYING DRAWINGS

FIG. 5 is an enlarged perspective view of a portion of the subject combing template, with cable conductors being drawn through respective channels provided in the template pursuant to the teachings of the present invention.

FIGS. 6, 7, and 8, are frontal diagramatic views of combing template channels profiled pursuant to the present invention. The views illustrate in sequence the addressing and combing of a plurality of cable conductors into appropriate channels.

DETAILED DESCRIPTION OF THE PREFERRED EMBODIMENT

Figure 4:
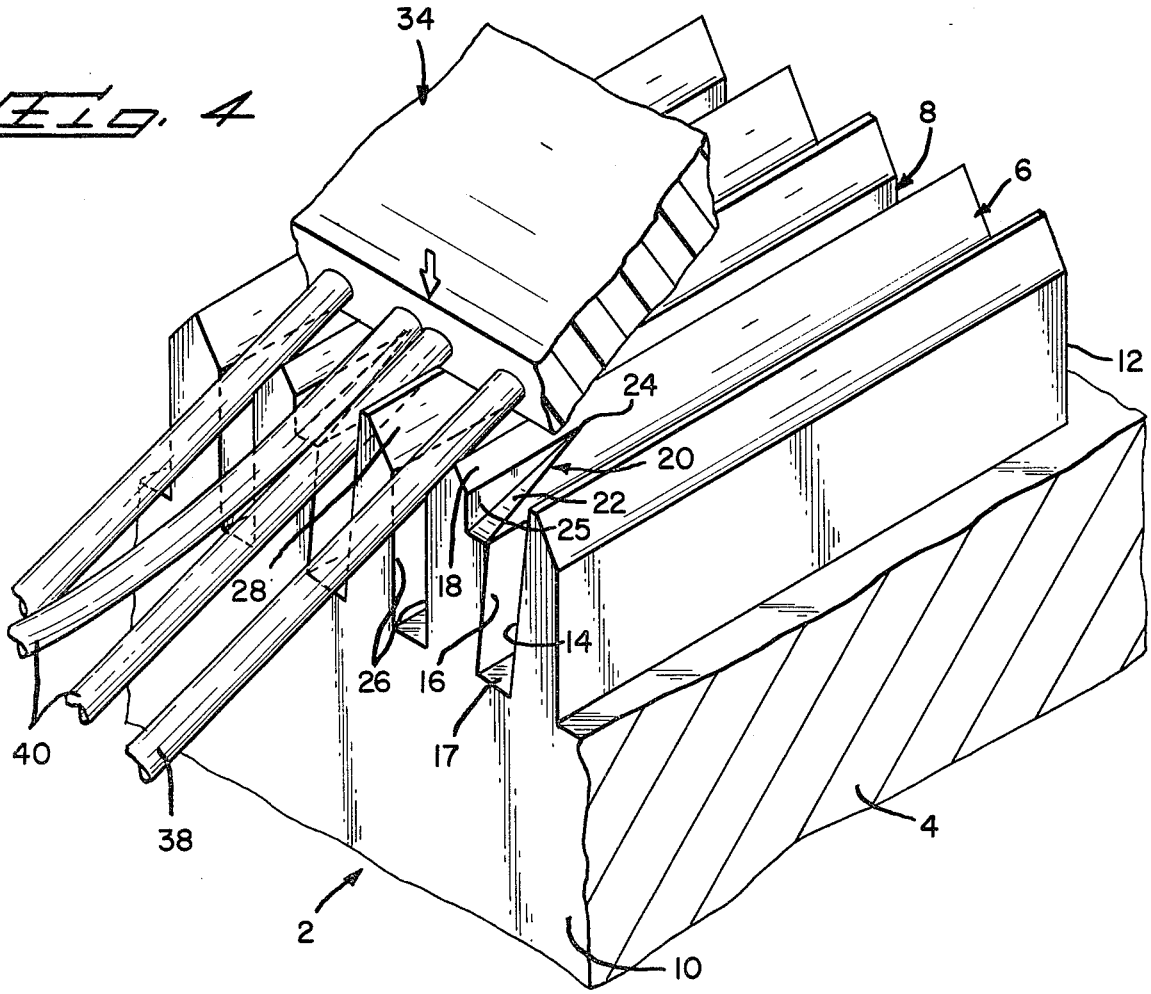
FIG. 4 is an enlarged perspective view of a section of the combing template showing selective conductors entering appropriate channels therein.

Referring first to FIG. 4, the subject combing template 2 is illustrated to comprise a base block 4, and a row of alternately spaced dual conductor receiving channels 6, and single conductor receiving channels 8, which extend from a forward end 10 to a rearward end 12 of the base block 4. Each of the dual conductor receiving channels 6 comprises a pair of parallel spaced apart sidewalls 14, 16, and a floor surface 17 which connects bottom longitudinal edges of the sidewalls 14, 16. The sidewall 16 is adapted having a longitudinal outwardly flared upper surface 18, into which a tapered cut 20 is provided. The tapered cut 20 includes a ramping surface 22 which extends from the forward end 10 of the base block 4, toward the rearward end 12. Further, the ramping surface 22 inclines upwardly within the flared surface 18, and has a width which decreases therealong to a terminal point 24 located on the surface 18. The upwardly ramping surface 22 is perpendicular with respect to a side surface 25 of the tapered cut 20.

Each of the single conductor channels 8 provided in the subject combing template comprises a pair of vertical sidewalls 26, each having an upper longitudinal flared lead in surface 28 as shown.

Referring now to FIGS. 5 and 6, it should be noted that adjacent pairs of dual conductor receiving channels 6 and single conductor channels 8 are separated by a first profiled tooth 30, which is adapted having a substantially greater material thickness than an adjacent second profiled tooth 32. This greater material thickness is required in order to accommodate the creation of the tapered cut 20 in the upper flared surface 18 of the first profiled tooth 30. Providing for greater material thickness, however, would normally result in the bottom surfaces of the channels 6, and 8, being on unequal center lines. To compensate for this undesirable consequence, pursuant to the present invention the parallel sidewalls 14, 16, of each dual conductor receiving channel 6 are adapted to skew inwardly in bias toward the larger width tooth 30. Resultingly, the bottom floor surface 17 of each dual conductor receiving channel 6 is translated inwardly to a location generally beneath the tapered cut 20 of each larger tooth 30, and is thereby located equidistant between the single conductor channels 8 on either side. In skewing the parallel sidewalls 12, 14, of each dual conductor receiving channel 6 toward the thicker tooth 30, not only does an equal center line spacing result, but such a skewing enables the adjacent tooth 32 to have a greater stock thickness at the base (indicated at numeral 33 of FIG. 6), which provides for greater structural strength.

Referring back to FIG. 4, the subject combing template is intended to function on a transmission cable 34, of the type comprising an outer dielectric sheath 36, and a plurality of coplanar signal conductors 38 and dual ground conductors 40, which are alternately positioned across the width of the cable. As shown, pursuant to the present invention, the outer dielectric sheath 36 is stripped away from forward lengths of the signal conductors 38 and the dual ground conductors 40, in preparation for the combing operation.

Figure 1:
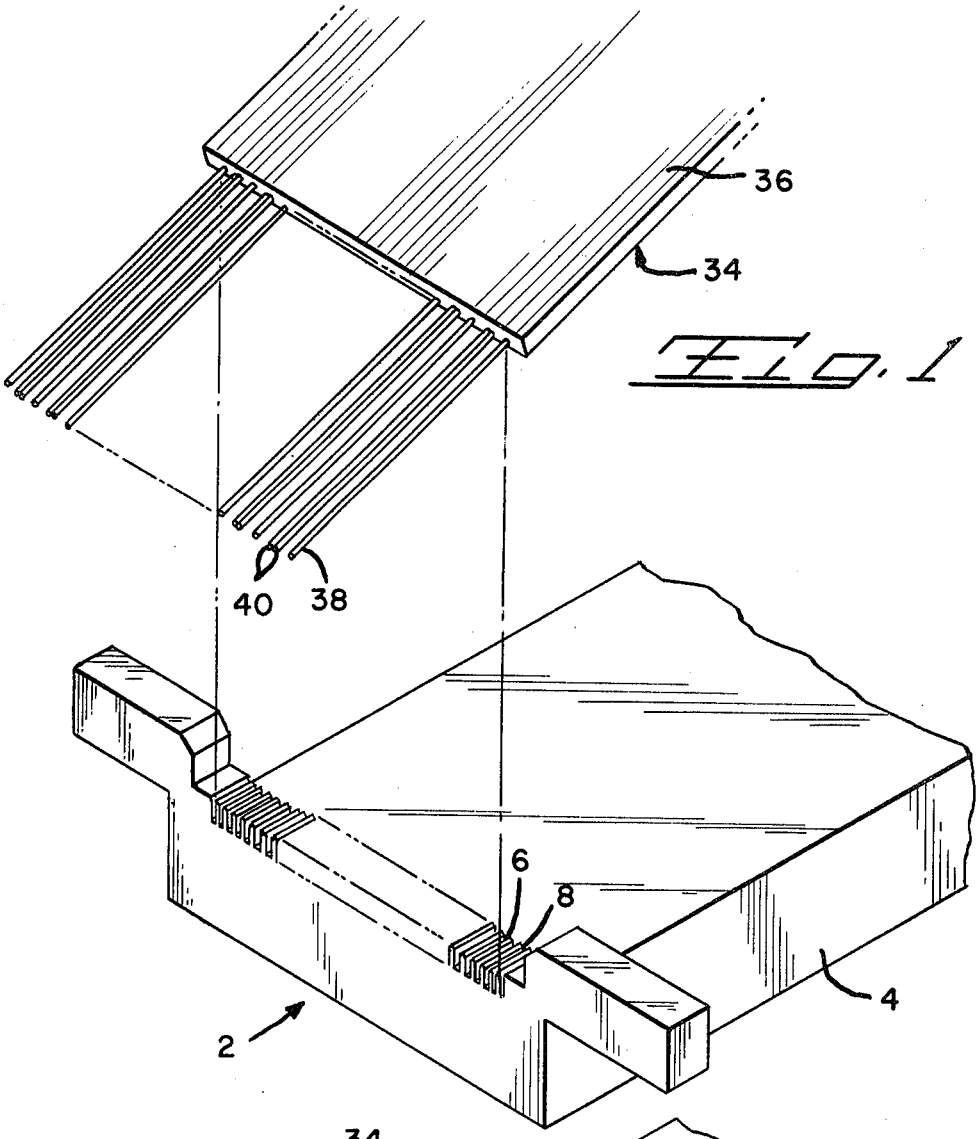
FIGS. 1, 2, 3, are perspective views of the subject combing template and a multiconductor cable, illustrating in sequence the addressing of the cable conductors into the combing template channels pursuant to the teachings of the present invention.
Figure 2:
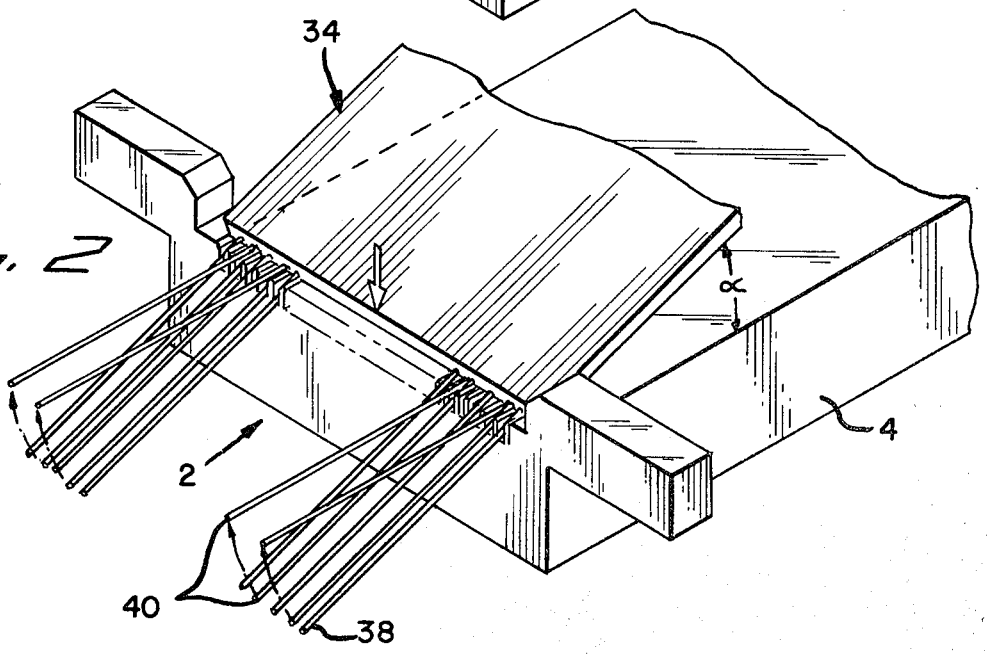

The operation of the subject combing template proceeds as follows, with sequential reference to FIGS. 1 through FIG. 8. First referring to FIG. 1, the cable 34 is addressed to the combing template 2 from above, and is further lowered at a specified angle alpha, $\alpha$, so that the conductors 38, 40, enter the conductor receiving channels 4, 6, on a downward bias. As shown by FIGS. 2, 4, and 6, one of the dual ground conductors 40, upon entering a dual conductor receiving channel 6, engages against the ramping surface 22 of the tapered cut 20, and is momentarily deterred thereby from entering into the channel 6. Maintaining constant downward pressure on the cable, every ground conductor 40 in engagement with a respective tapered cut bottom surfaces 22, tends to splay upward from the tension introduced therein. The other one of each dual ground conductor pair, conductor 40 freely enters into a respective channel 6 at this point in the combing sequence.

It will be noted that the tolerance latitude of cable acceptability of the device is extremely liberal, due to the initial entrance lead-in angles of the channels. Thus, the likelihood of lacing the conductors into appropriate respective channels is exceptionally high, and relatively insensitive to tolerance variations in the dimensions of the cable.

Subsequently, the cable is simultaneously drawn backwardly and lowered downwardly across the face of the combing template 2, with the angle $\alpha$ therebetween being continuously reduced as shown by FIG. 5. In so doing, the dual ground conductor 40 is lowered along the tapered cut ramping surface 22, in a continuous and progressive fashion. When the cable has been drawn back sufficiently, and the angle $\alpha$ reduced substantially, the ground conductor 40 will approach the terminal point 24 of the tapered cut 20, and thereupon roll into the channel 6 in superior relationship to the other conductor 40 previously positioned therein. This occurence is illustrated by FIG. 7. The conductors are then lowered within their respective channels to the bottom floor surfaces thereof as shown by FIG. 8, and are thereby located on an equal center line spacing.

It will be appreciated from the above described insertion procedure of the conductors into the combing channels, that the combing operation is continuous and occurs in a three dimensional fashion. By first introducing the conductors into the channels at a specified angle, and applying downward tension thereupon, the conductors separate and splay in a preferred manner. Then, by continuously drawing the cable backward and simultaneously lowering the conductors toward the template, appropriate pairs of the conductors are thereby re-oriented 90 degrees by operation of the tapered cut into a vertical axial relationship, with one conductor axially atop the other conductor in the channel.

Note from FIG. 6, that when the pair of conductors are first introduced into the channel, the profile of the channel cut does not impart a horizontal vectoral component of force on the conductor 40. Without a horizontal force component, binding between the conductors 40 in the channel is impossible. Only until the conductor 40 is rolled to the inward end of the tapered cut, illustrated in FIG. 7, does the template impart a horizontal force component to influence the conductor 40 into the channel. Prior combing templates, utilizing unidirectional downward insertion of conductors into a slot, created the possibility for an occurrence of an equilibrium condition, with all horizontal and vertical force components cancelling out. This occurrence resulted in a binding situation, and invariably damaged one or more of the conductors. The present invention, however, eliminates this possibility since conductor 40 has cleared itself downward within the channel by the time the conductor 40 reaches the roll-off point of FIG. 7.

Figure 3:
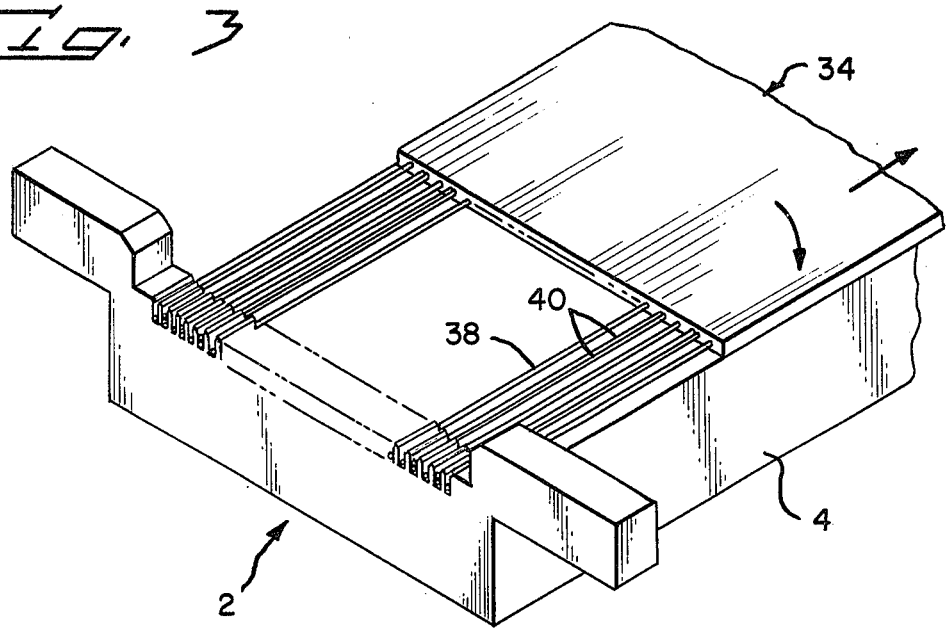

FIG. 3 illustrates the cable as being fully inserted into the combing template 2, with each of the cable conductors 38, 40, aligned within a respective channel of the template. There situated, the conductors 38, 40, are held in a readily locateable position, and may be advanced and terminated subsequently in a controlled fashion.

While the above description of the preferred embodiment exemplifies the principles of the present invention, other embodiments which will be apparent to one skilled in the art and which utilize the teachings herein set forth are intended to be within the scope and spirit of the present invention.

What is claimed is:

1. A combing device for transposing a pair of axially adjacent conductors into a modified axial relationship, comprising:

support block means having at least one profiled channel extending downwardly into a top surface thereof, said channel being defined by parallel sidewalls spaced apart to closely admit the diameter of one of said conductors, and said channel extending from a forward conductor receiving end of said support block means to a rearward conductor-nesting end;

one of said sidewalls having an upper longitudinal surface adapted to flare outwardly to said block means top surface;

said upper flared sidewall surface having a tapered profiled cut therein defined by a side and a bottom surface, said tapered cut extending from said forward conductor receiving end toward said rearward conductor nesting end with said profiled cut bottom surface extending into said upper sidewall portion a decreasing depth therealong.

2. A combing device as set forth in claim 1, wherein said tapered cut bottom surface inclines upwardly and rearwardly from said forward conductor receiving end toward said rearward conductor nesting end.

3. A combing device as set forth in claim 2, wherein said tapered cut bottom surface extends from said forward conductor receiving end toward said rearward conductor nesting end, and terminating at a point on said upper sidewall flared surface.

4. A combing device as set forth in claim 1, wherein said channel parallel sidewalls skew laterally toward a bottom of said channel, so that said bottom of said channel is shifted to a desired centerline location.

5. A combing device as set forth in claim 1, wherein said side and said bottom surfaces defining said tapered cut being perpendicular.

6. A combing device for rotating a pair of axially adjacent conductors 90 degrees into a vertically parallel relationship, comprising:

support block means having at least one profiled channel extending downwardly into a top surface thereof, said channel being defined by parallel sidewalls spaced apart to closely admit the diameter of one of said conductors therebetween, said channel extending from a forward conductor receiving end of said support block means to a rearward conductor nesting end;

one of said sidewalls having an outwardly flared upper surface portion extending the longitudinal length thereof;

said flared surface having a tapered profiled cut formed therein defined by perpendicular side and bottom surfaces, said tapered cut extending from said forward conductor receiving end toward said rearward conductor nesting end with said profiled cut bottom surface inclining upwardly within said flared sidewall surface, and decreasing in width therealong to terminate at a point on said flared sidewall surface.

7. A combing device as set forth in claim 6, wherein said channel sidewalls skew laterally toward a bottom of said channel, so that said bottom of said channel is shifted to a desired centerline location.

8. A combing device for transposing and orienting conductors in a multiple conductor cable into a prescribed centerline spacing, comprising:

supporting block means having a row of alternating single conductor receiving and dual conductor receiving channels extending into a top surface thereof, with a plurality of combing barriers separating adjacent ones of said channels;

alternate ones of said combing barriers being comparatively thicker than combing barriers adjacent thereto, whereby each of said channels is situated between one thicker combing barrier and one thinner combing barrier;

each said thicker combing barrier having transposing means, said transposing means comprising deterring and splaying means facing into a respective one of said dual conductor receiving channels for momentarily deterring movement of a first one of adjacent dual conductors of the cable into the dual conductor receiving channel and for splaying the adjacent dual conductors by axially rotating the first one of the adjacent dual conductors 90 degrees into said respective conductor receiving channel over a second one of the adjacent dual conductors;

each said single conductor receiving channel being defined by a pair of spaced apart vertical sidewalls of adjacent said barriers;

each said dual conductor receiving channel being defined by a pair of spaced apart sidewalls of adjacent said barriers skewed laterally so that bottoms of said dual conductor receiving channels are shifted to an equal centerline spacing with said single conductor receiving channels.

9. A combing device as set forth in claim 8, wherein said transposing means of each said thicker combing barrier comprising:

an upper longitudinal surface adapted to flare outwardly to said block means top surface;

said flared surface having a tapered profiled cut formed therein defined by perpendicular side and bottom surfaces, said tapered cut extending from a forward end of said combing barrier toward a rearward end, with said profiled cut bottom surface inclining upwardly within said flared surface and decreasing in width therealong to terminate at a point on said flared sidewall surface.

10. A combing device for transposing and orienting conductors in a multiple conductor cable into a prescribed centerline spacing, comprising:

support block means having a row of alternating single conductor receiving and dual conductor receiving channels extending into a top surface thereof with a plurality of combing barriers separating adjacent said channels;

alternate ones of said combing barriers having transposing means, said transposing means comprising deterring and splaying means facing into a respective one of said dual conductor receiving channels for momentarily deterring movement of a first one of adjacent dual conductors of the cable into the dual conductor receiving channel and for splaying the adjacent dual conductors by axially rotating the first one of the adjacent dual conductors 90 degrees into said respective conductor receiving channel over a second one of the adjacent dual conductors; and each said single conductor and dual conductor receiving channel being defined by a pair of spaced apart parallel sidewalls.

11. A combing device as set forth in claim 10, wherein said transposing means comprises:

an upper longitudinal surface adapted to flare outwardly to said block means top surface;

said flared surface having a tapered profiled cut formed therein defined by perpendicular side and bottom surfaces, said tapered cut extending from a forward end of said combing barrier toward a rearward end, with said profiled cut bottom surface inclining upwardly within said flared surface and decreasing in width therealong to terminate at a point on said flared sidewall surface.

12. A combing device as set forth in claim 10 wherein the sidewalls of said dual conductor receiving channels are skewed laterally so that bottoms of said dual conductor receiving channels are shifted to an equal centerline spacing with said single conductor receiving channels.

* * * * *